US009051671B2

(12) United States Patent
Lizaso

(10) Patent No.: US 9,051,671 B2
(45) Date of Patent: Jun. 9, 2015

(54) BOBBIN THREAD MONITOR

(76) Inventor: Jerry R. Lizaso, Costa Mesa, CA (US)

( * ) Notice: Subject to any disclaimer, the term of this patent is extended or adjusted under 35 U.S.C. 154(b) by 902 days.

(21) Appl. No.: 13/317,047

(22) Filed: Oct. 6, 2011

(65) Prior Publication Data

US 2013/0087086 A1 Apr. 11, 2013

(51) Int. Cl.
*D05B 69/36* (2006.01)
*D05B 59/02* (2006.01)

(52) U.S. Cl.
CPC ..... *D05B 59/02* (2013.01); *D05B 69/36* (2013.01)

(58) Field of Classification Search
CPC ..... D05B 51/00
USPC ..... 112/273, 278, 229, 231, 279, 223, 224, 112/470.01, 470.02; 242/118, 118.3, 118.4
See application file for complete search history.

(56) References Cited

U.S. PATENT DOCUMENTS 5,267,518 A * 12/1993 Arnold et al. ..... 112/475.02
5,769,343 A * 6/1998 Tomioka et al. ..... 242/472.6
6,092,478 A * 7/2000 Simakrai et al. ..... 112/278

* cited by examiner

*Primary Examiner* — Tejash Patel
(74) *Attorney, Agent, or Firm* — Roy A. Ekstrand

(57) ABSTRACT

A bobbin thread monitor includes a rotatable thread pulley together with a rotation sensing counter and numeric count display. During bobbin loading, the thread supply is looped about the pulley in a first direction resulting in rotation of the thread pulley in a corresponding first direction. The rotation of the thread pulley in the first direction produces an accumulated account within the rotation sensing and display apparatus. During sewing operations, the thread supply is looped about the thread pulley in a second opposite direction loop resulting in opposite direction rotation of the thread pulley during the sewing process. The opposite direction rotation of the thread pulley during the sewing process produces a downcount of the number accumulated during the bobbin loading process. This down count is indicative of bobbin supply remaining and may be used to activate additional alarm apparatus.

14 Claims, 5 Drawing Sheets

Fig 9
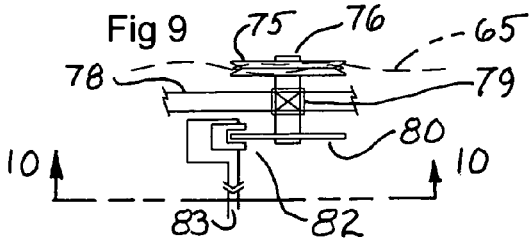
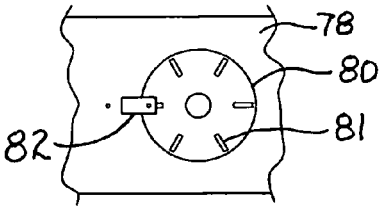
Fig 10
Fig 11
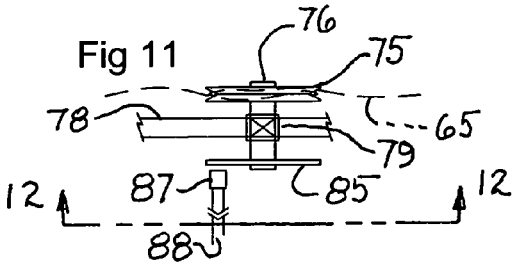
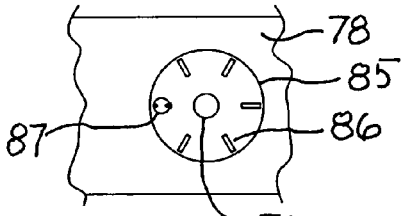
Fig 12
Fig 13
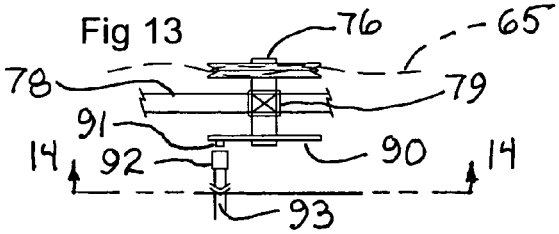
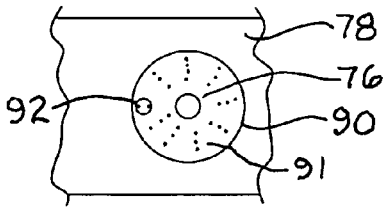
Fig 14

Fig 15
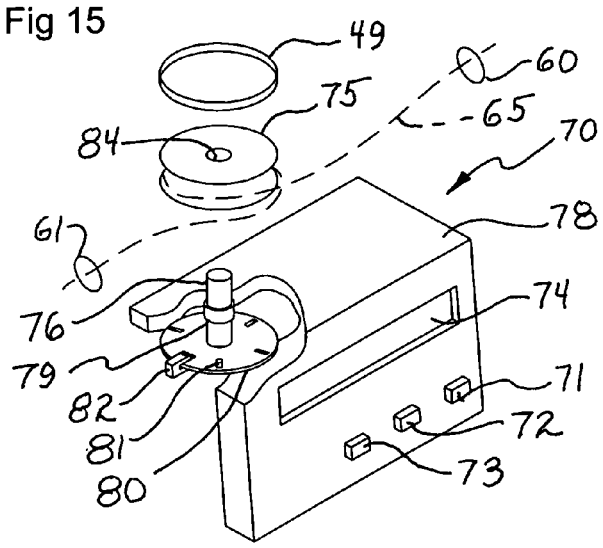
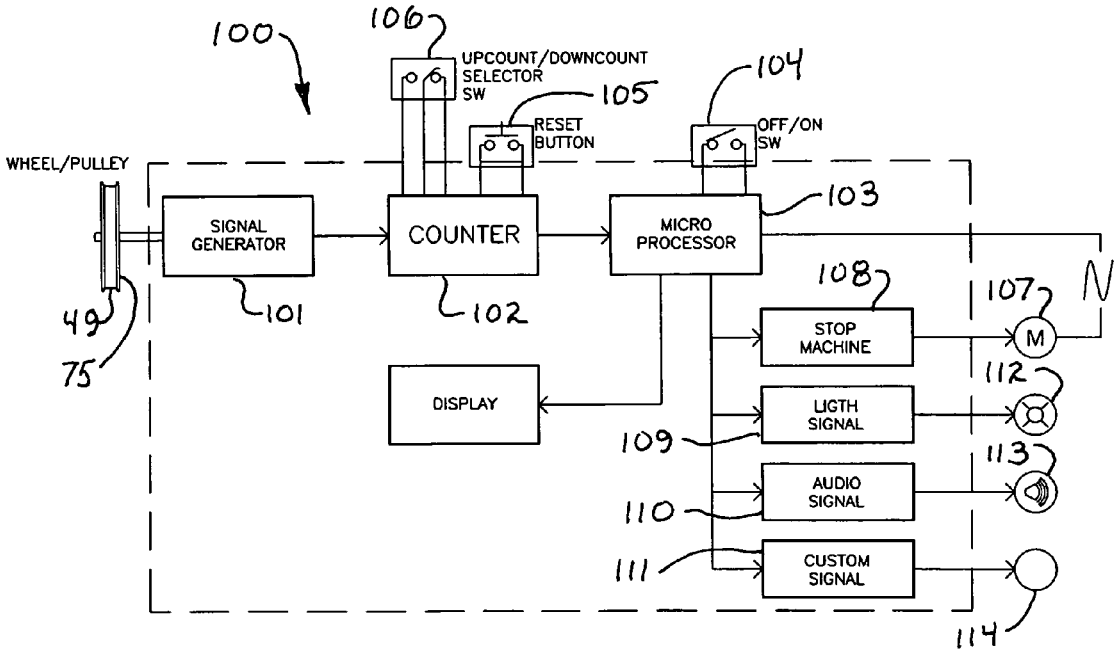
Fig 16

BOBBIN THREAD MONITOR

FIELD OF THE INVENTION

This invention relates generally to sewing machines and particularly to apparatus for monitoring the supply of bobbin thread supported upon the bobbin during the sewing operation.

BACKGROUND OF THE INVENTION

In a typical sewing machine of the type often referred to a "lockstitch" machine, the to-be-sewn fabric or work-piece is moved beneath a sewing head and is passed over a sewing machine platen positioned directly beneath the sewing head. The platen typically includes an elongated aperture together with a pair of fabric advancing mechanisms positioned on each side of the aperture.

The sewing machine head supports a sewing needle reciprocating and stroke movement mechanism which moves the needle vertically in a repetitive stroke. The needle moves from a raised position above the platen through a downwardly traveling stroke extending into the platen aperture and then returns upwardly to the raised position. This vertical up and down reciprocating motion is repeated as the work-piece or fabric is being moved through the machine.

In a typical sewing machine, two supplies of thread are utilized. The primary supply is housed upon a spool usually supported on an upper surface of the machine. This primary supply of thread is fed to the needle and thus is typically referred to as the "needle" thread. The needle thread is drawn from the primary spool atop the machine and is passed through various guides and tensioners finally being passed through an aperture formed near the pointed bottom end of the needle.

The second supply of thread for the sewing machine is wound upon a smaller spool known as the bobbin which is supported beneath the machine platen. Typically, the bobbin also supports a stitch-locking mechanism which functions to interlock the bobbin thread and the needle thread to form the machine stitching. Proper thread tension for the needle thread and bobbin thread is required for correct functioning of the machine.

In most sewing machines, a mechanism is provided which facilitates winding a quantity of thread onto the bobbin prior to sewing. While certain machines use a separate bobbin winder and bobbin thread supply, most provide a built in bobbin winding mechanism which allows the user to wind a quantity of thread from the main thread spool atop the machine. Thereafter, the thread is cut and the bobbin is positioned beneath the platen. The remaining end of the thread spool is passed through the appropriate guides and tensioners and the aperture in the needle.

Because the bobbin is much smaller than the main spool atop the sewing machine, the amount of thread wound upon the bobbin usually referred to as the "bobbin" thread is substantially less than the supply of needle thread stored in the main spool atop the sewing machine. The smaller amount of bobbin thread wound upon the bobber, causes the bobbin thread supply to be frequently exhausted during sewing. Once the bobbin thread runs out, sewing must be halted and the bobbin changed or reloaded.

The frequent stops during sewing operations required to reload the bobbin thread supply are annoying and vexing to the sewing machine operator. However, perhaps even more annoying is the continued run-out of the sewing machine which occurs prior to the machine operator detecting the exhaustion of bobbin thread. Usually, the machine operator must back up to a point upstream of the bobbin thread run-out occurrence and reposition and restart the stitching operation after replenishing the bobbin supply.

Because of the problems and difficulties associated with bobbin thread supply exhaustion, practitioners in the art have endeavored to provide apparatus which in some manner monitors the supply of thread upon the bobbin and alerts the machine operator to imminent bobbin thread exhaustion. For example, U.S. Pat. No. 3,832,960 issued to Mayer, et al. sets forth a NEEDLE THREAD MONITOR TO AVOID RUN-OUT OF BOBBIN THREAD includes a bobbin winding device having a counting wheel and a bobbin thread counter is provided for winding a bobbin to its maximum capacity with a known supply of bobbin thread. A needle thread counter having a counting wheel is supported upon the machine within the needle thread path. The needle thread counter is set to terminate operation of the stitching mechanism prior to the run-out of the known supply of bobbin thread which has been wound upon the bobbin. A warning mechanism is also utilized to alert the operator to the remaining thread.

U.S. Pat. No. 3,991,692 issued to Papajewski, et al. sets forth a BOBBIN THREAD DEPLETION DETECTOR FOR SEWING MACHINE in which a machine bobbin is provided with a rotation counter utilizing an electronic sensor and cooperating slidable flange secured to the bobbin. When the thread is removed from the bobbin, the slidable end flange will drop from the environment of the sensor producing an inductance change which is detected and which is used to signal imminent thread exhaustion.

U.S. Pat. No. 2,420,275 issued to Winberg sets forth a BOBBIN THREAD CONTROLLED SIGNAL FOR SEWING MACHINES in which a supply of thread upon the bobbin is determined by the sliding position of a bobbin spool portion. The position of the bobbin spool portion is moved under the influence of a spring as the supply of thread is removed from the bobbin. An electrical sensor is provided which responds to the movement of the bobbin portion to trigger an alert.

U.S. Pat. No. 2,647,482 issued to Campbell sets forth a BOBBIN SIGNAL having an electric switch in a circuit utilizing a suitable warning device together with means for operatively connecting the switch to the bobbin holder of a sewing machine such that the presence of bobbin thread on the bobbin maintains the switch in an open condition. When the bobbin thread is nearing depletion, the switch is actuated setting the alarm condition.

U.S. Pat. No. 3,129,680 issued to Doemer sets forth a BOBBIN THREAD DEPLETION DETECTOR FOR SEWING MACHINES which includes a magnetic reed switch supported adjacent the sewing machine bobbin together with a biasing magnet supported in a fixed relation to the switch. A magnetic field produced by the magnet maintains the switch in a closed position. As bobbin thread is depleted, the magnet is moved causing interruption of the switch and alarming the operator or terminating machine operation.

U.S. Pat. No. 3,601,073 issued to Simpson sets forth SEWING MACHINES having a bobbin holder receiving and supporting a bobbin such that the bobbin is moved to a signaling position when little or no thread remains on the bobbin. The bobbin is held in a normal position by the thread upon the bobbin when the thread supply is substantial.

U.S. Pat. No. 4,432,297 issued to Kemmel sets forth a LOW THREAD SUPPLY MONITOR IN A SEWING MACHINE having an optical sensor positioned in association with a rotary hook bobbin case. A pulse transmitter is connected to the machine drive shaft to supply pulses to a control circuit connected to the optical sensor. The control circuit responsive to the pulse activates the optical sensor at the appropriate time for monitoring the thread supply on the bobbin.

While the foregoing described prior art devices have to different extents improved the art, there remains nonetheless a continuing and unresolved need in the art for an effective, low cost and reliable system and apparatus for monitoring the bobbin thread supply in a sewing machine.

SUMMARY OF THE INVENTION

Accordingly, it is a general object of the present invention to provide an improved sewing machine. It is a more particular object of the present invention to provide an improved sewing machine within which an effective bobbin thread monitoring apparatus is situated. It is a still more particular object of the present invention to provide an improved bobbin thread monitor which makes effective use of the relationship between the amount of needle thread and bobbin thread utilized during the sewing process.

In accordance with the present invention, there is provided for use with a sewing machine having a needle thread drawn from a main thread spool and a bobbin thread wound upon a bobbin, a bobbin thread monitor comprising: a thread pulley rotationally supported upon a sewing machine; a rotation counter operatively coupled to the thread pulley producing a count in response to rotation of the thread pulley; display means for displaying the count; and thread guide means for guiding means for guiding a thread used by a sewing machine to travel to and from the thread pulley during bobbin loading and sewing operations of a sewing machine, the thread pulley having a thread looped about the thread pulley in a first direction to rotate in a first rotational direction during bobbin loading and having a thread looped about the thread pulley in a second opposite direction during sewing operations, the rotation counter increasing the count response to the first direction and decreasing the count in response to the second direction.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 9 sets forth a partial section view of the present invention bobbin thread monitor taken along section lines 9-9 in FIG. 8;

FIG. 10 sets forth a partial section view of the present invention bobbin thread monitor taken along section lines 10-10 in FIG. 9;

FIG. 11 sets forth a partial section view of an alternate embodiment of the present invention bobbin thread monitor taken along section lines 9-9 in FIG. 8;

FIG. 12 sets forth a partial section view of the present invention bobbin thread monitor taken along section lines 12-12 in FIG. 11;

FIG. 13 sets forth a partial section view of a still further alternate embodiment of the present invention bobbin thread monitor taken along section lines 9-9 in FIG. 8;

FIG. 14 sets forth a partial section view of the present invention bobbin thread monitor taken along section lines 14-14 in FIG. 14;

FIG. 15 sets forth a partially sectioned perspective view of the embodiment of the present invention bobbin thread monitor set forth in FIGS. 9 and 10; and FIG. 16 sets forth a block diagram of the present invention bobbin thread monitor control circuitry.

DESCRIPTION OF THE PREFERRED EMBODIMENTS OF THE INVENTION

Figure 1:
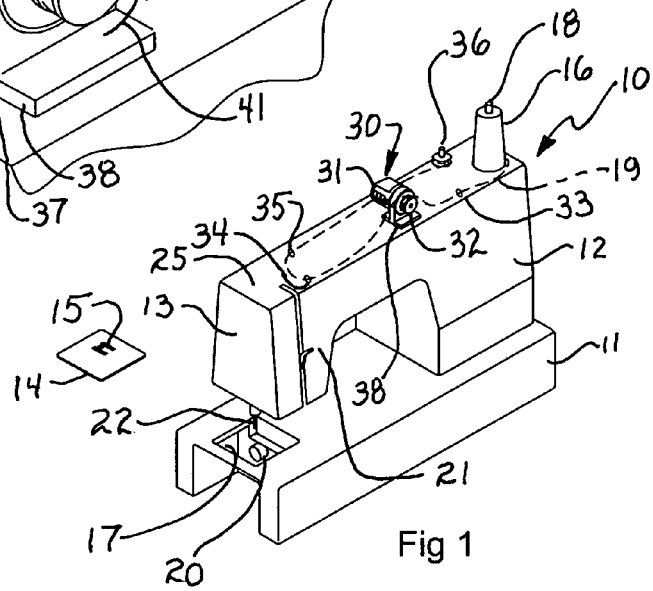
FIG. 1 sets forth a perspective view of a typical sewing machine supporting a bobbin thread monitor constructed in accordance with the present invention during bobbin thread loading.

FIG. 1 sets forth a perspective view of a sewing machine generally referenced by numeral 10. Apart from the bobbin monitor apparatus applied to sewing machine 10, sewing machine 10 is entirely conventional in fabrication and includes a supporting base 11 upon which a main housing 12 is secured. Main housing 12 further supports a sewing head 13 positioned above a platen receptacle 17 formed on the upper surface of base 11. In further accordance with conventional fabrication techniques, a bobbin 20 is supported beneath platen receptacle 17 and is configured in accordance with conventional fabrication. A platen 14 defining an elongated aperture 15 is receivable within platen receptacles 17. In further accordance with conventional fabrication of sewing machine 10, main housing 12 defines a top surface 25 upon which an upwardly extending shaft 18 is supported. Sewing head 13 further defines an elongated slot within which a movable thread tensioner 21 is supported. Sewing head 13 further supports a needle carriage and sewing needle 22.

As thus far described, sewing machine 20 may be entirely conventional in fabrication and will be understood to include conventional motor drive apparatus and suitable mechanical apparatus which is operative to reciprocate needle 22 above platen 14 during the stitching operation. In further accordance with conventional operation of sewing machine 10, it will be understood that bobbin 20 which is conventional in fabrication is also conventional in operation and is driven by conventional apparatus (not shown) which provides cooperative movement of bobbin thread as needle 22 bearing needle thread is reciprocated during the stitching process.

Sewing machine 10 is shown in FIG. 1 in the bobbin loading configuration in which a quantity of thread is wound upon bobbin 20 prior to the sewing operation. As depicted in FIG. 1, a main spool of needle thread 16 is rotatably supported upon shaft 18. A thread 19 is drawn from spool 16 and is wound upon a conventional bobbin supported upon bobbin winder 36. During the bobbin winding operation, an operative mechanism within main housing 12 (not shown) which is entirely conventional rotates the bobbin supported upon bobbin winder 36 to draw a supply of thread 19 from main spool 16. Once the quantity of thread has been wound upon bobbin 20 by bobbin winder 36, bobbin 20 is again positioned as shown in FIG. 1.

As described thus far, sewing machine 10 is, as mentioned above, entirely conventional in fabrication. In accordance with the present invention, a thread monitor 30 is also shown in FIG. 1 and is positioned upon top surface 25 of housing 12. It will be apparent to those skilled in the art from the descriptions and illustrations which follow that thread monitor 30 may be variously positioned upon main housing 12 so long as it is interposed within the travel path of thread 19 between main spool 16 and bobbin winder 36. Thus, in the preferred fabrication of the embodiment of the present invention thread monitor shown in FIG. 1, a plurality of thread guides 33, 34 and 35 are supported upon top surface 25 of main housing 12 to produce a travel path for thread 19 which extends forwardly from main spool 16 and returns in alignment with bobbin winder 36. Accordingly, thread monitor 30 is positioned upon top surface 25 between thread guides 33 and 34. The structure of thread monitor 30 is set forth below in FIG. 3 in greater detail. However, suffice it to note here that thread monitor 30 includes an elongated housing 31 secured to and supported by a flange 37 and a flange base 38. Additionally, it should be noted that thread monitor 30 supports a rotatable thread pulley 32.

It operation, thread 19 is drawn from main spool 16 and is passed through thread guide 33. Thereafter, thread 19 is looped about thread pulley 32 of thread monitor 30 and then passed through thread guides 34 and 35. Ultimately, the end of thread 19 is secured within bobbin 20 supported upon bobbin winder 36. In accordance with an important aspect of the present invention, and as is better seen in FIG. 3, thread 19 is looped about thread pulley 32 in a selected direction such that travel of thread 19 as it is drawn from main spool 16 and pass through thread guides 33, 34 and 35 to be wound upon bobbin 20 within bobbin winder 36 produces rotation of thread pulley 32 in a selected direction. By means described below in greater detail, thread monitor 30 responds to the thread-induced rotation of thread pulley 32 by accumulating a count corresponding to the number of rotations which thread pulley 32 undergoes. Thus, as bobbin winder 36 operates to draw thread from spool 16 and wind it upon bobbin 20, a count is accumulated within thread monitor 30 which corresponds to the length of thread drawn from spool 16 and wound upon bobbin 20.

Once the process of loading bobbin 20 upon bobbin winder 36 is complete, a bobbin thread count is accumulated by thread monitor 30.

Figure 2:
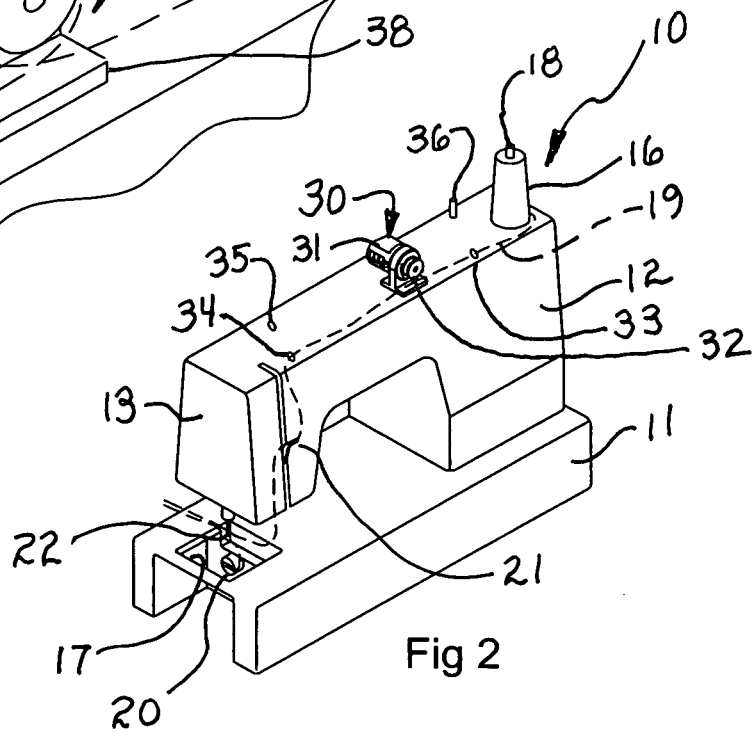
FIG. 2 sets forth a perspective view of a typical sewing machine having the present invention bobbin thread monitor thereon in a typical sewing configuration.

FIG. 2 sets forth a perspective view of sewing machine 10 following the completion of loading of bobbin 20 and the placement of bobbin 20 in its sewing position beneath platen receptacle 17. As described above, sewing machine 10 is apart from the present invention thread monitor substantially conventional in fabrication and includes a base 11 supporting a main housing 12 which in turn supports a sewing head 13. A needle 22 is supported within a reciprocating mechanism (not shown) within sewing head 13. Main housing 12 defines a top surface 35 upon which a plurality of thread guides 33 through 35 together with shaft 18 and bobbin winder 36 are supported. Sewing head 13 further supports a reciprocating tensioner 21. In the configuration shown in FIG. 2, sewing machine 10 is now configured for its sewing operation. Accordingly, thread 19 has been cut to allow removal of bobbin 20 from bobbin winder 36 for installation beneath platen receptacle 17. Additionally, a quantity of thread 19 is drawn from main spool 16 forwardly through thread guides 33 and 34. The end of thread 19 is passed through an aperture formed in tensioner 21 and is finally passed through an aperture in the lower end of needle 22.

In accordance with an important aspect of the present invention, thread monitor 30 remains positioned between thread guides 33 and 34 upon top surface 25 of housing 12. In further accordance with an important aspect of the present invention, thread 19 is looped about thread pulley 32 in the opposite direction to the loop created in the bobbin loading configuration shown in FIG. 1. This opposite direction thread loading is readily seen by comparing FIGS. 3 and 4. In operation, as sewing machine 10 operates in the sewing configuration in shown in FIG. 2, thread 19 is steadily drawn from spool 16 through thread guides 33 and 34 causing rotation of thread pulley 32. Once again, it will be recognized that the number of rotations which thread pulley 32 undergoes as thread 19 is drawn downwardly during the sewing process relates directly to the length of thread being used.

In further accordance with an important aspect of the present invention, the opposite direction looping of thread 19 upon thread pulley 32 of thread monitor 30 used in the bobbin loading process and the sewing process results in an upward count within thread monitor 30 during the bobbin loading process shown in FIG. 1 and a downward count during the sewing process shown in FIG. 2. As a result, thread monitor 30 initially accumulates a bobbin thread length count during the bobbin loading process which is counted down by thread monitor 30 during the sewing process. As a result, a single thread monitor operative during the bobbin loading and sewing operations provides a direct full proof monitor of bobbin thread supply. As has been determined, a direct relationship between the consumption of bobbin thread and needle thread during a typical sewing operation. It has been found for the most part that this relationship is substantially a direct one-to-one relationship. Accordingly, as needle thread and bobbin thread are consumed during the sewing process, the downward count of thread monitor 30 provides direct visual indication for the operator of the supply of thread remaining upon the bobbin. The use of a count up during bobbin loading and count down during sewing operations renders the bobbin thread monitoring of the present invention to be easily interoperated and understood. No separate tracking or information recording is required. Thus, the entire bobbin thread monitoring operation is carried forward by simply initializing the count on thread monitor 30 using reset button 40 (seen in FIG. 3) and thereafter loading bobbin 20 and accumulating a bobbin thread count. When sewing machine 10 is switched to the sewing configuration, the count accumulated in thread monitor 30 is maintained and provides the starting point from which the consumption of bobbin thread is observed by the downward count of thread monitor 30.

Figure 3:
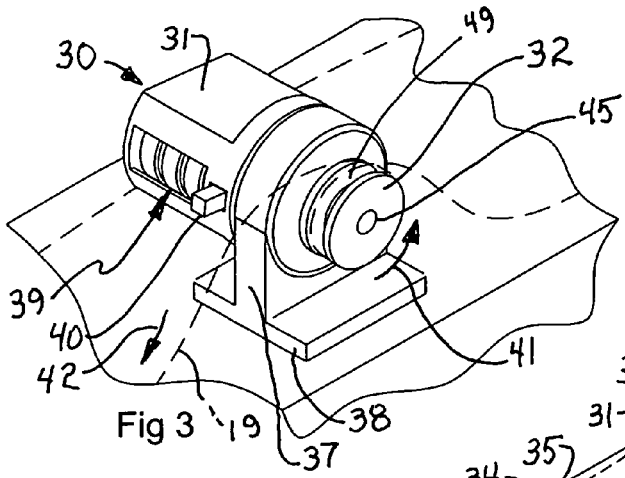
FIG. 3 sets forth an enlarged perspective view of the present invention bobbin thread monitor in the bobbin loading configuration.

FIG. 3 sets forth an enlarged perspective view of thread monitor 30 during the bobbin loading operation. As described above, thread monitor 30 includes an elongated housing 31 supported by a support flange 37 and a flange base 38. As is also described above, a thread pulley 32 supporting a friction O-ring 49 is rotatably supported upon a shaft 45 rotatable within flange 37. Thread monitor 30 further includes a count readout 39 and a reset button 40. Reset button 40 is pressed prior to the bobbin winding operation to provide a zero count for initial start. Thread 19 is looped about thread pulley 32 in a first direction such that movement of thread 19 in the direction indicated by arrow 42 by bobbin loading produces a rotation of thread pulley 32 in the direction indicated by arrow 41. This rotation is coupled by shaft 45 to the count mechanism (not shown) within monitor 30.

In the embodiment of the present invention shown in FIG. 3, thread monitor 30 is provided by utilization of a fish line monitor which, may for example, comprise the fish line monitor manufactured and sold by Weihai Gloria Fishing Tackle Co. under the tradenames LC001, LC002A and LC002B. It will be apparent however that other fish line monitoring devices or their equivalent may be utilized in carrying forward the present invention without departing from the spirit and scope of the present invention.

Figure 4:
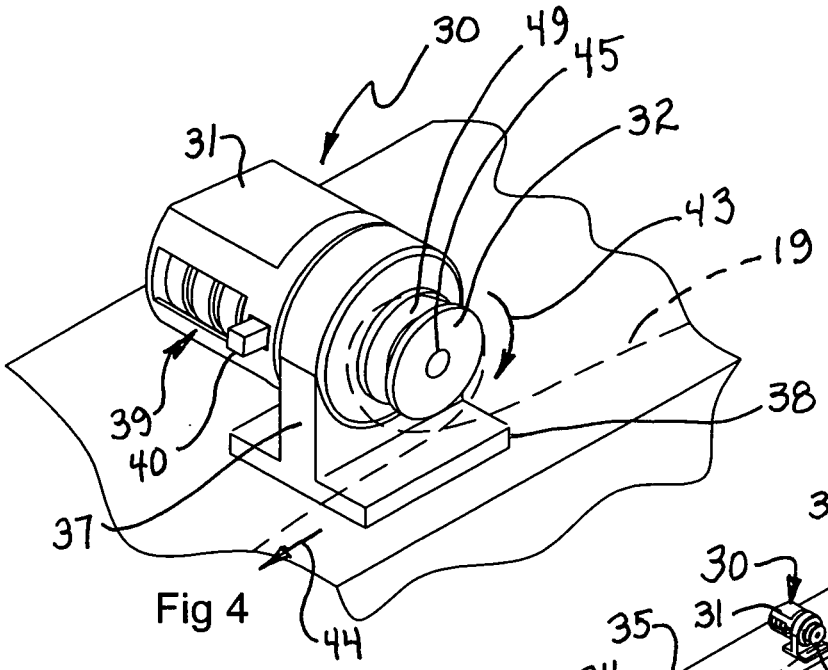
FIG. 4 sets forth an enlarged perspective view of the present invention bobbin thread monitor in the sewing configuration.

FIG. 4 sets forth a perspective view of thread monitor 30 substantially identical to the view shown in FIG. 3 with the difference being found in the accommodation of the sewing operation rather than the bobbin loading operation. As mentioned above, the sewing operation is accommodated by looping thread 19 about thread pulley 32 in the opposite direction to the loop formed during the bobbin loading operation. Accordingly, with thread 19 looped about thread pulley 32 in the direction shown and with an accumulated account on readout 39 corresponding to the amount of thread which has been previously wound upon the bobbin in the manner described above, the initiation of the sewing operation draws thread 19 in the direction indicated by arrow 44. Because of the loop direction of thread 19 about thread pulley 32, this thread movement rotates thread pulley 32 in the opposite direction shown by arrow 43. Comparison of FIGS. 3 and 4 will reveal that this opposite direction rotation produces a down count of the number displayed by readout 39. As described above, the user simply observes the count shown by readout 39 to determine the amount of thread remaining upon the sewing machine bobbin.

Figure 5:
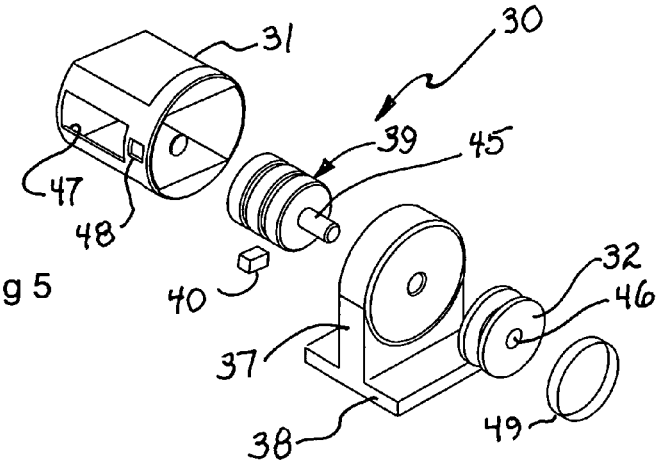
FIG. 5 sets forth a perspective assembly view of the present invention bobbin thread monitor.

FIG. 5 sets forth a perspective assembly view of thread monitor 30. As mentioned above, thread monitor 30 preferably comprises a conventional fish monitor of the type mentioned above. Accordingly, thread monitor 30 includes an elongated housing defining a window aperture 47 and a button aperture 48. Thread monitor 30 further includes a support flange 37 and a base 38. An aperture 46 within flange 37 receives a shaft 45 which in turn supports a thread pulley 32 and a count readout 39. Thread pulley 32 further supports an O-ring 49 preferably formed of an elastic friction material such as rubber or soft plastic. O-ring 49 functions to friction couple pulley 32 and thread 19 during rotation. Reset button 40 is received within aperture 48. Thread monitor 30 is assembled by extending shaft 45 through aperture 46 to receive thread pulley 32. Thereafter, housing 31 is positioned against flange 37 and reset button 40 passed through aperture 48. Because thread monitor 30 utilizes the above-mentioned conventional fish line monitor, the operation of thread monitor 30 and the details of its construction have been omitted. Suffice it to say that as thread pulley 32 is rotated in a first direction, a numeric count is accumulated by readout 39 which is visible through window 47. As thread pulley 32 is rotated in a second opposite direction, the count accumulated within readout 39 which is visible through window 47 is down counted or decremented. A reset mechanism (not shown) operative within readout 39 responds to reset button 40 to zero the accumulated count to provide an initial starting count.

Figure 6:
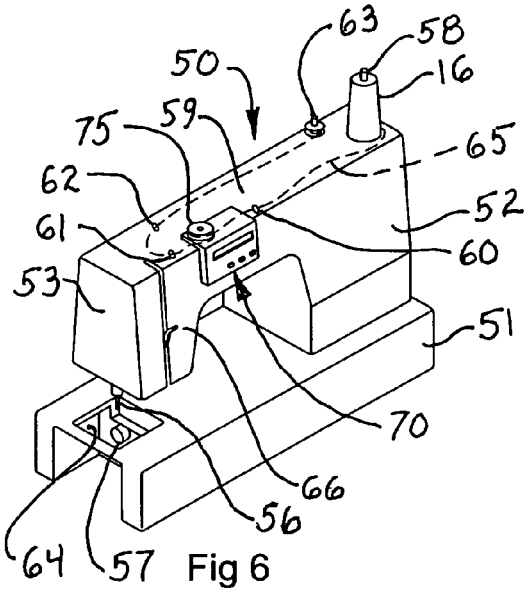
FIG. 6 sets forth a perspective view of a typical sewing machine having an alternate embodiment of the present invention bobbin thread monitor thereon during the bobbin loading operation.

FIG. 6 sets forth a perspective view of a sewing machine supporting an alternative embodiment of the present invention bobbin thread monitor. A sewing machine 50 includes a supporting base 51 and a main housing 52. Housing 52 further supports a sewing head 53 within which a sewing needle 56 is supported. Base 51 defines a platen receptacle 64 which receives a platen 54. A bobbin 57 is supported beneath platen receptacle 64. Platen 54 is received within platen receptacle 64 and defines an elongated aperture 55 therein. Main housing 52 further includes a top surface 59 upon which a main spool shaft 58 is supported. Also supported upon top surface 59 is a conventional bobbin winder 63.

The structure of sewing machine 50 as thus far described is fabricated entirely with conventional fabrication techniques and will be understood to include conventional motor drive apparatus as well as mechanisms for providing a sewing action as needle 56 is reciprocated and as bobbin 57 performs its lock stitch operation. In accordance with the present invention, sewing machine 50 further includes a plurality of thread guides 60, 61 and 62 supported upon top surface 59. In further accordance with the present invention, sewing machine 50 includes a thread monitor 70 having a housing 78 built into main housing 52 of sewing machine 50. Thus, it will be apparent that the embodiment of the present invention shown in FIG. 6 differs from the embodiment set forth above in FIG. 1 in that thread monitor 70 is fabricated as an integral part of sewing machine 50 rather than the add on construction utilized in the embodiment set forth above in FIG. 1.

Housing 78 supports an internal apparatus set forth below in FIGS. 9 through 14. Suffice it to note here that housing 78 of thread monitor 70 further supports a thread pulley 75 which is supported for rotation upon housing 78 and which is oriented in a horizontal plain.

FIG. 6 shows sewing machine 50 in the bobbin winding configuration in which a quantity of thread is drawn from main spool 16 to be wound upon bobbin 57 when bobbin 57 is positioned within bobbin winder 63. Thus, in the loading configuration shown in FIG. 6, a quantity of thread 65 is drawn from main spool 16 and passed through guide 60. Thereafter, and as is better seen in FIG. 8, thread 65 is looped about thread pulley 75 and then passed through guides 61 and 62 to be ultimately wound upon bobbin 57 positioned within bobbin winder 63. As bobbin winder 63 is activated, thread 65 is drawn from main spool 16 through guides 60 through 62. As thread 65 is drawn through guides 60 and 61, the loop that is formed about thread pulley 75 causes rotation of thread pulley 75 which provides the basic input to thread monitor 70. In the manner set forth below in FIGS. 9 through 14, the rotation of thread pulley 75 which occurs as thread 65 is wound upon bobbin 57 under the action of bobbin winder 63 activates the internal sensing and counting apparatus (seen in FIG. 16) of thread monitor 70. Accordingly, as thread 65 continues to be drawn and loaded onto the bobbin, a thread length count is accumulated within thread monitor 70. As is better seen in FIG. 8, thread monitor 70 includes a display 74 which provides a numeric display corresponding to the length of thread 65 which is wound upon bobbin winder 63. Once the loading of bobbin 57 is complete, thread 65 is cut near bobbin 57 and bobbin 57 is positioned beneath platen 54 for sewing operation.

Figure 7:
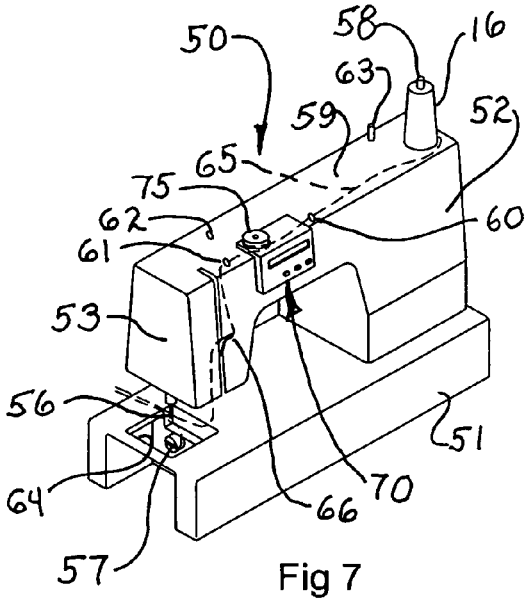
FIG. 7 sets forth a perspective view of an illustrative sewing machine having the embodiment of the present invention bobbin thread monitor set forth in FIG. 6 during the sewing configuration.

FIG. 7 sets forth a perspective view of sewing machine 50 having thread monitor 70 operative therein following configuration of the sewing machine to its sewing configuration. Thus, as is described above, sewing machine 50 includes a base 51 supporting a main housing 52 which in turn supports a sewing head 53. A top surface 59 of housing 52 supports a shaft 58 upon which a main spool 16 is supported. Top surface 59 further supports a plurality of thread guides 60 through 62 together with a conventional bobbin winder 63. A platen receptacle 64 receives a platen 54 beneath which a bobbin 57 is supported. Sewing head 53 supports a needle 56 together with apparatus for reciprocating the needle. A thread tensioner 66 is positioned with sewing head 53 and defines a thread aperture at the end thereof.

In accordance with the invention, thread monitor 70 having housing 78 is installed within main housing 52 of sewing machine 50. In further accordance with the present invention, housing 78 of thread monitor 70 supports a rotating thread pulley 75.

In the sewing configuration of sewing machine 50 shown in FIG. 7, thread 65 which as is described above has been drawn from main spool 16 and is passed through thread guides 60 and 61. Thread 65 further passes downwardly through the aperture formed in the end of tensioner 66 and thereafter is passed through the aperture of needle 56. With bobbin 57 in place, machine 50 is ready for sewing operation. In further accordance with the present invention, thread 65 remains looped about thread pulley 75. It will be noted in FIGS. 9 through 16 below that thread 65 remains looped about thread pulley 75 in the same direction as the thread loop utilized during the bobbin loading operation shown in FIG. 6. It is not necessary to reverse the rotation of thread pulley 75 because up/down counter 102 (seen in FIG. 16) is easily configured to count down during sewing operations using switch 106 (also seen in FIG. 16).

Figure 8:
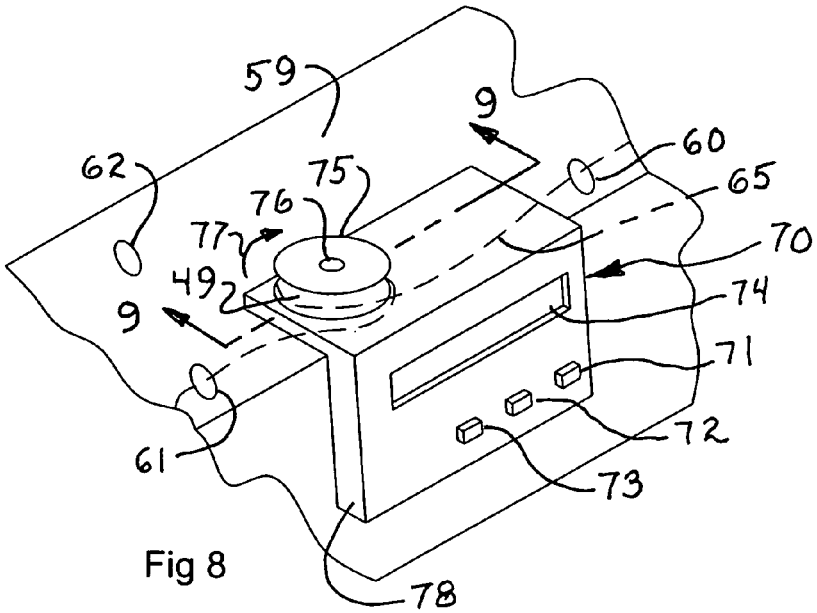
FIG. 8 sets forth an enlarged perspective view of the present invention bobbin thread monitor shown in FIGS. 6 and 7.

With temporary reference to FIG. 8, it will be noted at as thread 65 is drawn through guides 60 and 61 rotation of thread pulley 75 in the direction indicated by arrow 77 occurs. Returning to FIG. 7, as thread 65 is drawn from main spool 16 during the sewing process, the indicated direction rotation of thread pulley 75 is continued as counter 102 produces a downward count of the counting mechanism (seen in FIGS. 9 through 16) within thread monitor 70. This downward count is visible within display 74 (better seen in FIG. 8).

During this sewing operation, the downward count occurring within thread monitor 70 provides direct indication of the amount of needle thread being drawn from spool 16. Since the amount of needle thread being used which produces this down count of thread monitor 70 is related directly to amount of bobbin thread being consumed from bobbin 57, the remaining count at any given time within display 70 is indicative of the amount of thread available on bobbin 57. This direct relationship results from the utilization of thread monitor 70 during both the bobbin loading process accumulating the bobbin thread count and the use of thread monitor 70 to decrease the accumulated bobbin thread count as needle thread is moved during the sewing operation. As a result, a single unit is utilized in the bobbin loading process and the sewing process to provide a directly related displayed bobbin thread count which is usable in monitoring the amount of thread remaining upon the bobbin.

FIG. 8 sets forth an enlarged perspective view of thread monitor 70 supported within main housing 52 of sewing machine 50. As described above, thread monitor 70 includes a housing 78 which defines a display 74 and which supports a plurality of operational buttons. With concurrent reference to FIGS. 8 and 16, button 71 actuates on/off switch 104 while button 72 actuates reset switch 105 and button 73 actuates upcount/downcount selector switch 106.

Returning to FIG. 8, housing 78 further supports a shaft 76 which further supports a thread pulley 75. In the manner shown below in FIGS. 9 through 14, shaft 76 extends into housing 78 and is coupled to a rotation sensor within thread monitor 70.

By way of overview, the operative mechanism within thread counter 70 utilizes a rotational sensor wheel and a count sensor coupled to thread pulley 75 to produce a series of signal corresponding to the rotation of thread pulley 75. This series of signals is applied to an updown counter in the manner shown in FIG. 16 to produce a corresponding thread length indicative numeric display upon display 74. It will be apparent to those skilled in the art that a variety of different rotational sensor apparatus may be utilized to produce the counting signals responsive to the rotation of thread pulley 75. For purposes of illustration, FIGS. 9 through 14 set forth three different types of rotational sensing wheels and sensors for carrying forward the operative mechanism within thread monitor 70. However, it will be understood that these mechanisms are provided for purposes of illustration and should not be considered to be limiting. A number of additional mechanisms known in the art may be utilized for performing the function of converting the rotation of thread pulley 75 to a counting signal.

With concurrent reference to FIGS. 9 and 10, housing 78 includes a bearing 79 which rotationally supports a shaft 76 extending through an aperture formed in housing 78. Shaft 76 supports thread pulley 75 above housing 78 and further supports an optical encoder wheel 80. An optical sensor 82 is supported in proximity to encoder wheel 80 by conventional support means (not shown) and is operatively coupled to the remainder of thread monitor circuit 100 (seen in FIG. 16) by connecting wires 83. In the embodiment of the present invention shown in FIGS. 9 and 10, encoder wheel 80 defines a plurality of light transmissive apertures 81 spaced about the outer portion of the encoder wheel. Correspondingly, optical sensor 82 includes a conventional light emitting diode (LED) supported on one side of encoder wheel 80 and a light sensing device (such as a photo transistor) supported on the opposite side of encoder wheel 80. Such optical sensors are well known in the art and need not be further illustrated or discussed herein.

In operation, as encoder wheel 80 is rotated under the influence of thread pulley 75 and shaft 76, apertures 81 are passed between the elements of sensor 82 producing alternating light transmission and light blocking which in turn produces a series of pulse signals coupled to the operative circuit within thread monitor 80. It will be noted by examining FIGS. 9 and 10, that sensor 82 produces this series of pulse signals in response to rotation of encoder wheel 80 in either direction.

With concurrent reference to FIGS. 11 and 12, an alternate embodiment of the present invention thread monitor is shown which utilizes an optical encoder apparatus which employs a reflective sensing system. Correspondingly, housing 78 supports bearing 79 which in turn rotatably supports shaft 76 having thread pulley 75 supported thereon. A reflective optical encoder wheel 85 is supported upon shaft 76 together with an optical sensor 87. Sensor 87 is operatively coupled to circuit 100 (seen in FIG. 16) by connecting wires 88.

Optical encoder wheel 85 supports a generally reflective surface upon which a plurality of less reflective radio marks 86 are formed. Correspondingly, optical sensor 87 includes a conventional LED directed toward encoder wheel 85 together with a light sensing device which receives reflection therefrom. In operation, rotation of optical encoder wheel 85 under the influence of thread pulley 75 alternates the surface presented to sensor 87 between the reflective surface of encoder wheel 85 and less reflective radial marks 86. Once again is the result is the production of a series of pulse signals indicative of the rotation of thread pulley 75.

With concurrent reference to FIGS. 13 and 14, an embodiment of the present invention is illustrated which utilizes a magnetic sensing apparatus in place of the optical sensing apparatus illustrated in FIGS. 9 through 12. Accordingly, shaft 76 is rotatably supported within housing 78 by a bearing 79. Thread pulley 75 is supported on the upper end of shaft 76 while a magnetic encoder wheel 90 is supported on the interior end. Encoder wheel 90 supports a plurality of magnetic elements 91 which are generally evenly spaced about the outer portion of magnetic wheel 90. A magnetic sensor 92 such as a conventional Hall—Effect device which produces an output signal each time magnetic elements 91 pass in proximity to the sensor. This output signal is coupled by connecting wires 93 to the remainder of circuit 100 (seen in FIG. 16).

In operation, as magnetic encoder wheel 90 is rotated under the influence of thread pulley 75, a plurality of pulse signals are produced by sensor 92 which are coupled via connecting wires 93.

FIG. 15 sets forth a partially section perspective assembly view of thread monitor 70. As mentioned above, thread monitor 70 includes a housing 78 having a display 74 supported thereon. As is also described above, housing 78 supports an on/off button 71, a reset button 72 and an up/down button 73. Housing 78 defines an aperture within which a bearing 79 supports a shaft 76. A thread pulley 75 having a friction O-ring 49 is received upon the outer end of shaft 76 while an optical encoder wheel 80 is supported upon the interior end of shaft 76. An optical sensor 82 is supported in proximity to optical encoder wheel 80 by conventional support means (not shown). As is better seen in FIG. 8, a pair of thread guides 60 and 61 are positioned on either side of thread monitor 70. In accordance with the present invention, a quantity of thread 65 is passed through thread guide 60 and thereafter looped around thread pulley 75 and is then drawn through thread guide 61. Thus, thread 65 passes through thread guide 60 and around thread pulley 75 to then pass through thread guide 61.

In operation, as thread 65 is drawn through guides 60 and 61, thread pulley 75 is rotated during the bobbin loading process and a corresponding bobbin thread count is accumulated within thread monitor 70 and displayed by display 74. As is described above, the user transitions from bobbin loading to sewing operation by cutting thread 65 near the loaded bobbin while leaving the thread loop wound about thread pulley 75. The user then activates up/down count button 73 to reverse the counting process within thread monitor 70 produced by rotation of thread pulley 75. In this manner, the display count in display 74 accumulates as the operator loads the machine bobbin and thereafter decreases counting down as the machine operates in a sewing configuration.

FIG. 16 sets forth a block diagram of the operative circuitry within thread monitor 70 generally referenced by numeral 100. Circuit 100 includes a signal generator 101 which is operatively coupled to thread pulley 75 by a shaft 76. Thread pulley 75 further supports a friction O-ring 49. Signal generator 101 may be fabricated utilizing conventional rotation sensing apparatus such as the examples set forth above in FIGS. 9 through 14 or an equivalent sensing apparatus. Signal generator 101 is coupled to a counter 102 which in turn is coupled to the input to a microprocessor 103. Counter 102 is a bi-directional counter and thus includes an upcount/downcount selector switch 106. Counter 102 further includes a reset switch 105. Microprocessor 103 is fabricated in accordance with conventional fabrication techniques and includes a memory within which a stored instruction set is housed. Microprocessor 103 includes an on/off switch 104. In addition, microprocessor 103 is operatively coupled to a machine control driver 108, a light signal driver 109, an audio signal driver 110 and a custom alarm signal driver 111. Driver 108 is coupled to a sewing machine motor 107 while light signal driver 109 is coupled to an alarm light 112. Audio signal driver 110 is coupled to an audible alarm sounder 113 while custom signal driver 111 is coupled to a corresponding alarm device chosen by the user. Microprocessor 103 is further coupled to a multi digit display device 115. Display 115 provides the numeric count indication provided by display 74 (seen in FIG. 8) and is fabricated in accordance with conventional fabrication techniques such as an LED readout device.

In operation, circuit 100 is initially operated as the machine bobbin is loaded in the manner described above to provide rotation of pulley 75. Correspondingly, up count/down count selector switch 106 is switched to the up count position and reset switch 105 is actuated. As a result, the count within counter 102 is configured to zero on display 115. As the bobbin thread is wound, rotating thread pulley 75, signal generator 101 operates in the above-described manner to produce a series of pulse signals which are applied to counter 102. Counter 102 responds by counting upwardly producing a succession of numeric inputs which are applied to processor 103. In response, processor 103 configures display 115 to provide a numeric display of the accumulated count within counter 102. Additionally, processor 103 compares the accumulated count to a plurality of stored numbers within the microprocessor. These stored numbers correspond to the desired numeric counts used to activate drivers 108 through 111. Since the bobbin winding process is carried forward with switch 106 in the upcount position, the accumulated count within the microprocessor 103 will not correspond to any of the alarm conditions and drivers 108 through 111 remain inactive. Once the bobbin loading process is completed, the host sewing machine is configured for the sewing operation which includes reversing the thread loop upon thread pulley 75. In addition, the user configures circuit 100 of thread monitor 70 for sewing operation by switching upcount/downcount switch 106 to the downcount position. Thereafter, as the machine is operated and the looped thread rotates thread pulley 75 in the opposite direction, a plurality of pulse signals are produced by signal generator 101. These pulses applied to counter 102 which is now configured in a downcount mode by switch 106 result in numeric signals applied to processor 103 which decrease the accumulated count within the processor. Correspondingly, the numeric display shown on display 115 indicates a decreasing numeric count. As the count within processor 103 is decreased, the processor compares the accumulated count to the plurality of stored alarm values within the processor memory. The values which produce alarm signals within processor 103 are determined largely by design choice. For example, it may be desired to store different count numbers for activating signal drivers 108 through 111. One example would be to be to produce an initial alarm signal applied to driver 111 producing an alarm 114 at a first count. Thereafter, as the count further decreases indicating a further use of bobbin thread, the next alarm count is reached and driver 110 is activated producing an audible alarm using audible device 113. Continuing this example, as a still lower count is accumulated within processor 103, driver 109 is then activated producing a light signal alarm using device 112. As a final alarm condition indicative of a prohibitively low amount of bobbin thread being available is reached, a low numeric count within processor 103 activates driver 108. Driver 108 is intended to be the final alarm condition because driver 108 interrupts the operation of sewing machine motor 107. The interruption of operation of sewing machine motor 107 terminates the sewing operation avoiding a runout or exhaustion of bobbin thread.

Because the accumulated count within microprocessor 103 is also visible by observation of display 115, the decreasing count within microprocessor 103 may be observed by the machine operator directly. This allows the machine operator to independently monitor the amount of thread remaining upon the machine bobbin.

What has been shown is a novel bobbin thread monitor which utilizes a single thread monitor device during the bobbin loading and sewing operations of an otherwise unaltered sewing machine to provide effective avoidance of bobbin thread exhaustion. The inventive bobbin thread monitor may be readily utilized by an otherwise conventional sewing machine as an aftermarket or add-on device. Alternatively, the inventive bobbin thread monitor may be fabricated as an integral member within the sewing machine during the manufacturing process. In either application, the result is a bobbin thread monitor which maintains a visual display of bobbin thread supply which the user is able to observe directly during the sewing operation.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use with a sewing machine having a needle thread drawn from a main thread spool and a bobbin thread wound upon a bobbin, a bobbin thread monitor comprising:

a thread pulley rotationally supported in association with a sewing machine;

a rotation counter operatively coupled to said thread pulley producing a count which is increased in response to rotation of said thread pulley in a first direction and decreased in response to rotation of said thread pulley in a second opposite direction;

display means for displaying said count; and thread guide means for guiding a thread used by a sewing machine to travel about said thread pulley during bobbin loading and sewing operations of a sewing machine, said thread pulley having a thread looped about said thread pulley in a first direction to cause said thread pulley to rotate in a first rotational direction during bobbin loading and in a second opposite direction during sewing operations, said rotation counter increasing said count response to said first direction and decreasing said count in response to said second direction, wherein said rotation counter includes a housing rotationally supporting said thread pulley and said display means.

2. The bobbin thread monitor set forth in claim 1 wherein said rotation counter includes a housing support coupled to said housing and constructed to be secured to a surface of a sewing machine.

3. The bobbin thread monitor set forth in claim 2 wherein said thread guide means includes a pair of spaced apart thread guides each having thread apertures for passing thread therethrough and wherein said thread pulley is positioned between said spaced apart thread guides and wherein thread travels through said spaced apart thread guides during bobbin loading and sewing operations.

4. The bobbin thread monitor set forth in claim 3 wherein said thread pulley defines a thread groove and includes a friction material ring disposed therein.

5. The bobbin thread monitor set forth in claim 4 wherein said rotation counter includes a reset button for setting said displayed count to zero.

6. For use with a sewing machine having a needle thread drawn from a main thread spool and a bobbin thread wound upon a bobbin, a bobbin thread monitor comprising:

a thread pulley rotationally supported in association with a sewing machine;

a rotation counter operatively coupled to said thread pulley producing a count in response to rotation of said thread pulley;

display means for displaying said count; and thread guide means for guiding a thread used by a sewing machine to travel about said thread pulley during bobbin loading and sewing operations of a sewing machine, said thread pulley having a thread looped about said thread pulley to cause rotation of said thread pulley during bobbin loading and during sewing operations, said rotation counter including an up/down count switch for increasing said count in response to said thread pulley rotation during bobbin loading and decreasing said count in response to said thread pulley rotation during sewing operations wherein said rotation counter includes:

a rotating member coupled to said thread pulley and rotated thereby;

sensing means for sensing rotation of said rotating member and producing counting signals; and a bidirectional up/down digital counter coupled to said sensing means for counting said counting signals and displaying a numeric count in response to said count; and further including alarm means responsive to a predetermined count for triggering an alarm.

7. The bobbin thread monitor set forth in claim 6 wherein said alarm is an audible sound producing device.

8. The bobbin thread monitor set forth in claim 6 wherein said alarm is a light producing device.

9. The bobbin thread monitor set forth in claim 6 wherein said alarm includes means for interrupting the operation of a sewing machine.

10. A bobbin thread monitor and a sewing machine having a needle thread drawn from a main thread spool and a bobbin thread wound upon a bobbin in combination, said combination comprising:

a sewing machine housing supporting said sewing machine;

a thread pulley rotationally supported upon said sewing machine housing;

a rotation counter operatively coupled to said thread pulley producing a count in response to rotation of said thread pulley;

display means for displaying said count; and thread guide means supported upon said housing for guiding a thread from said main spool about said thread pulley during bobbin loading and sewing operations of said sewing machine, said thread pulley having a portion looped about said thread pulley to produce rotation thereof during bobbin loading and during sewing operations, said rotation counter including an up/down count switch for increasing said count in response to said thread pulley rotation during bobbin loading and decreasing said count in response to said thread pulley rotation during sewing operations, wherein said rotation counter includes:

a rotating member coupled to said thread pulley and rotated thereby;

sensing means for sensing rotation of said rotating member and producing counting signals; and a bidirectional up/down digital counter coupled to said sensing means for counting said counting signals and displaying a numeric count in response to said count, further including alarm means responsive to a predetermined count for triggering an alarm.

11. The combination set forth in claim 10 wherein said alarm is an audible sound producing device.

12. The combination set forth in claim 11 wherein said alarm is a light producing device.

13. The combination set forth in claim 12 wherein said alarm includes means for interrupting the operation of said sewing machine.

14. The combination set forth in claim 10 wherein said bobbin thread monitor is integrally formed with said sewing machine housing.

* * * * *